US005460064A

United States Patent [19]

Zayat, Jr.

[11] Patent Number: 5,460,064

[45] Date of Patent: Oct. 24, 1995

[54] UNIVERSAL SOCKET TOOL

[76] Inventor: Charles D. Zayat, Jr., 100 New Hampshire St., Cranston, R.I. 02920

[21] Appl. No.: 320,908

[22] Filed: Oct. 11, 1994

Related U.S. Application Data

[63] Continuation-in-part of Ser. No. 229,955, Apr. 19, 1994.

[51] Int. Cl.[6] ..... B25B 13/58

[52] U.S. Cl. ..... 81/185; 81/DIG. 11; 81/442; 81/448

[58] Field of Search ..... 81/185, 436, 442, 81/448, DIG. 11; 269/266

[56] References Cited

U.S. PATENT DOCUMENTS 3,349,655 10/1967 Locke ..... 87/185
4,887,498 12/1989 Zayat .
5,287,778 2/1994 Cook ..... 87/185 X

*Primary Examiner*—James G. Smith
*Attorney, Agent, or Firm*—Salter & Michaelson

[57] ABSTRACT

A universal socket tool includes a housing having a square internal chamber which is open at a lower end thereof. An array of square pins is suspended in sliding relation in the chamber with the lower ends of the pins arranged for engagement with a plurality of different fastening elements. Selected pins include tapered lower ends for engagement with a slotted screw heads. The pin suspension system includes upper and lower plates mounted in spaced relation in the chamber. The plates have aligned apertures for slidably receiving the upper ends of the pins. A flange at the top of each pin is positioned above the upper plate and a lower end of each pin is located below the lower plate. Each pin is provided with a spring disposed around its upper end for returning the pins to their normal position after disengaging the fastening element. In a second embodiment of the universal socket tool, the suspension system includes a plurality of retainer elements and a plurality of springs each having a first end secured to the upper end of a corresponding pin and a second end secured to the retainer element. In a third embodiment of the universal socket tool, the suspension system includes an adhesive medium received in the chamber, and a plurality of springs each having a first end respectively secured to the upper end of a corresponding pin and a second end imbedded in the adhesive.

7 Claims, 6 Drawing Sheets

UNIVERSAL SOCKET TOOL

BACKGROUND AND SUMMARY OF THE INVENTION

This is a continuation-in-part of U.S. patent application Ser. No. 08/229,955 filed Apr. 19, 1994.

The instant invention relates to socket tools and more particularly to a universal socket tool which is operative for turning a plurality of different size fastening elements, such as nuts, bolts, slotted screws, phillips head screws, eye bolts, wing nuts, etc.

Universal socket tools have heretofore been known in the art. In this connection, the Applicant's earlier issued U.S. Pat. No. 4,887,498 represents the closest prior art to the subject invention of which the Applicant is aware. The '498 patent discloses a universal socket tool comprising a housing forming a chamber having an open lower end, and a bundle of over four hundred individual pins suspended longitudinally within the chamber by a plurality of side-by-side rails. The lower ends of the pins are adapted for engaging various fastening elements when the lower ends of the pins are pressed downwardly over the fastening element. The pins are suspended such that when the lower end of the pins engages with a fastening element, the engaged pins are forced to slide upwardly into the chamber. A highly complex spring assembly is provided for returning the pins to their original position after pressured engagement with the fastening element is removed. While the socket tool described in the '498 patent is highly effective in operation, the large number of small pins and complicated spring assembly make the device extremely difficult to assemble and expensive to manufacture. Accordingly, the prior art device has not found widespread acceptance among users.

The instant invention provides three improved embodiments of a universal socket tool which are simple in design, easy to assemble and inexpensive to manufacture. A first embodiment of the universal socket tool comprises a rectangular housing having a longitudinal chamber with an open lower end. The rectangular configuration of the housing prevents rolling of the socket tool when it is placed on a flat resting surface. An eight-by-eight array of one-eighth inch square pins are longitudinally oriented in the chamber wherein the lower ends of the pins are flush with the open end of the chamber and are adapted for engagement with a plurality of different size and shape fastening elements. A selected group of side-by-side pins have tapered end portions which are operative for engagement with a slotted or phillips head screw. The larger size, one-eighth inch square pins significantly reduce the number of pins required in the array while still retaining the same effectiveness in engaging and turning different size fastening elements. The pins are suspended in the chamber in individual sliding relation wherein engagement of the lower ends of the pins with a fastening element forces the engaged pins upwardly into the chamber. The suspension system includes upper and lower suspension plates which are mounted in closely spaced parallel relation in the chamber. The upper and lower suspension plates have aligned apertures for slidably receiving the pins. A flange at the top of each pin is positioned above the upper plate and the lower end of each pin is located below the lower plate. Each of the pins is further provided with a coil spring disposed around its upper end for returning the pins to their normal position after pressured engagement with a fastening element is terminated. The upper and lower suspension plates are preferably divided into four separate plate segments so that the pins can be assembled in sub-groups. In a second embodiment of the universal socket tool, the suspension system comprises a plurality of side-by-side retainer elements each having a plurality of downwardly extending mounting heads, and further comprises a plurality of springs each having a first end secured to the upper end of a corresponding pin and a second end received over a mounting head on a corresponding retainer element. The springs may be secured to the tops of the pins by an adhesive, or alternatively the tops of the pins may include mounting heads for receiving the end of the spring. In a third embodiment of the universal socket tool, the suspension system comprises an adhesive medium received in the chamber, and further comprises a plurality of coil springs each having a first end respectively secured to the upper end of a corresponding pin and a second end imbedded in the adhesive medium. The springs may be secured to the tops of the pins by an adhesive, or alternatively the tops of the pins may include mounting heads for receiving the end of the spring.

Accordingly, it is an object of the instant invention to provide a universal socket tool which is operative for engaging and turning a plurality of different size fastening elements.

It is another object to provide a universal socket tool which is inexpensive to manufacture.

It is yet another object to provide a universal socket tool having a housing with at least one flat side to prevent rolling when placed on a flat surface.

It is still another object to provide a universal socket tool wherein selected side-by-side pins have tapered end portions which are operative for engagement with a slotted or phillips-type screw head.

It is a further object to provide a universal socket tool having a simple suspension system which is easy to assemble.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
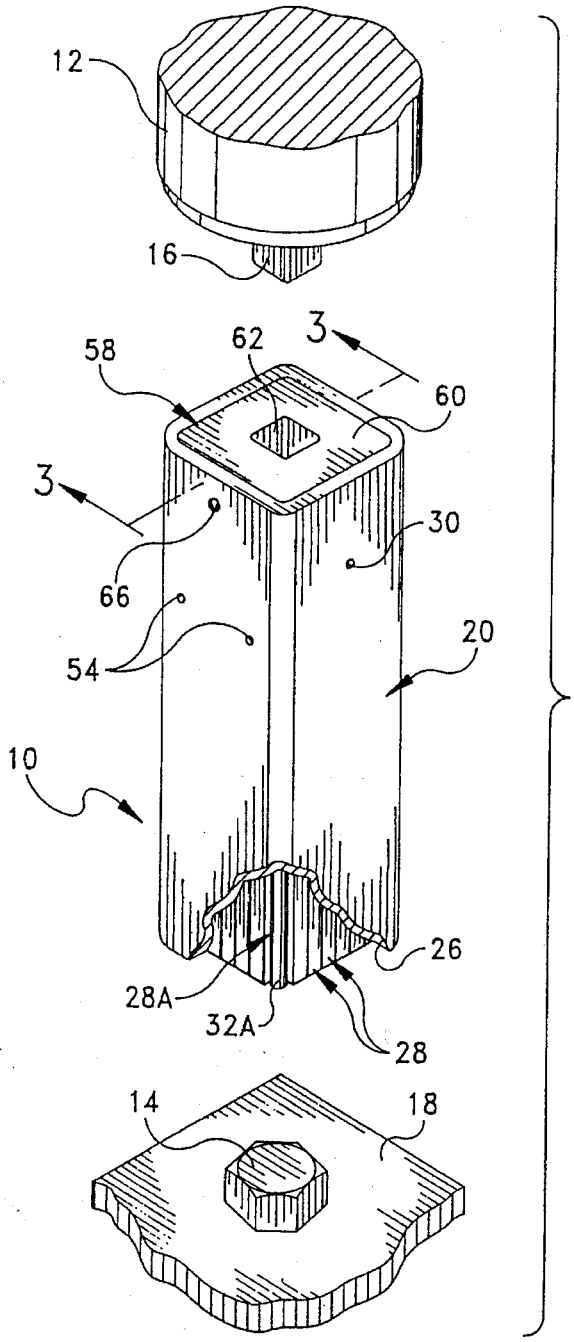
FIG. 1 is a perspective view of a first embodiment of the instant universal socket tool shown in connection with a drive wrench and fastening element.
Figure 2:
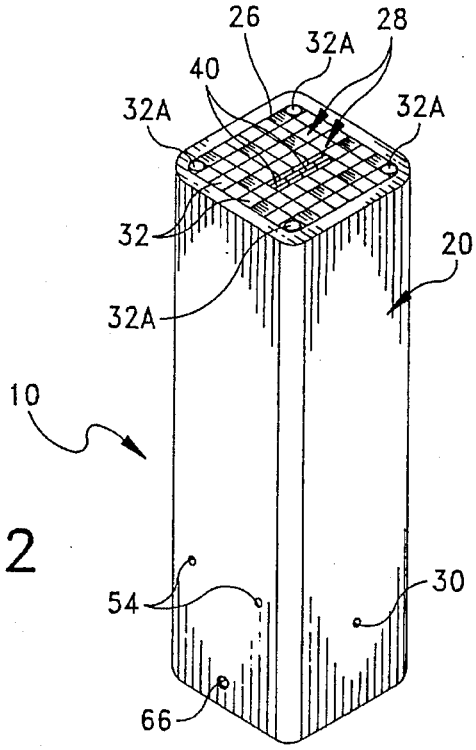
FIG. 2 is another perspective view thereof.
Figure 3:
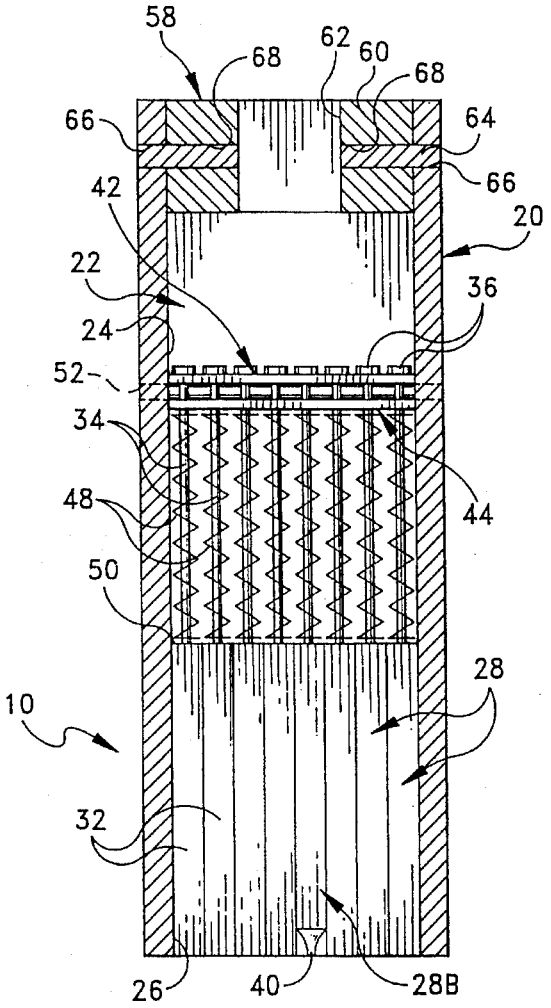
FIG. 3 is a cross-sectional view thereof taken along line 3—3 of FIG. 1.

Referring now to the drawings, the universal socket tool of the instant invention is illustrated and generally indicated at 10 in FIGS. 1–10. As will hereinafter be more fully described, the instant universal socket tool 10 is operative in connection with a drive tool 12 (partially illustrated) for turning a plurality of different fastening elements 14, such as nuts, bolt, screws, eye bolts and wing nuts. The drive tool 12 comprises a conventional socket driver having a square mounting lug 16. The fastening element 14 in FIGS. 1 and 7 comprises a hex head bolt which is threadedly mounted in the flat plate 18.

The universal socket tool 10 comprises a housing generally indicated at 20 including a longitudinal chamber generally indicated at 22 having an upper end 24 and an open lower end 26. The universal socket tool further comprises a plurality of individual pins generally indicated at 28 which are slidably suspended within the chamber 22. The housing 20 is preferably tubular in configuration, and in this connection, the housing preferably comprises a section of one and one-quarter (1¼) inch square tubular stainless steel. The stainless steel tubular housing has a one eighth inch thick outer wall which defines an internal longitudinal chamber 22 having a one inch by one inch dimension. The square outside configuration of the housing 20 provides an advantage over the cylindrical prior art devices in that it prevents rolling of the socket tool 10 when it is placed on a flat resting surface. The square design also allows a leveraging tool, such as an open-ended wrench, to grasp the housing 20 to aid in turning. While the housing 20 is shown to have a square configuration, it is to be understood that the housing 20 need only have one flat side to prevent rolling. For example, the housing 20 may be generally cylindrical with one flat surface, or it may be octagonal in configuration with eight flat surfaces. The housing 20 still further includes a small opening 30 adjacent the upper end thereof for receiving a cleaning fluid therein when desired.

Each of the individual pins 28 comprises a lower end consisting of a one-eighth inch square rod 32 and an upper end consisting of a cylindrical stem 34 having a flange 36 at the top thereof. The cylindrical stem 34 of the pin 28 is fixedly received into an axial bore 38 (FIGS. 4 and 5) formed in one end of the square rod portion 32. The pins 28 are arranged in an eight-by-eight array and are longitudinally oriented and slidably suspended in a first normal position (FIG. 3) within the chamber 22 so that the square rod portions 32 of the pins 28 are adjacent the open end 26 of the chamber 22. The pins 28 may be mounted so that they are flush with the end of the chamber 26 as illustrated in the drawings, or alternatively, the pins 28 may extend below the end of the housing 20 in order to engage below surface screws or bolts, such as those positioned in recessed cavities. The eight-by-eight array of one-eighth inch pins completely fills the one inch square chamber 22 of the tubular housing 20 so that the pins 28 are only permitted to move in vertical sliding relation. It is pointed out that the four corner pins 28A have lower ends consisting of round rods 32A to accommodate for the rounded internal corners of the tubular housing 20. The plurality of pins 28 further include a selected grouping of side-by-side pins 28B which have tapered end portions 40. The side-by-side tapered end portions 40 are operative for engagement with a slotted or phillips head screw 14B (See FIG. 9). It is contemplated that the tapered portions 40 of the pins 28 could be positioned on one side of the pin 28, such as illustrated in FIG. 10, whereby the tapered portions of the side-by-side pins would cooperate to form a blade. In this manner, the tapered blade would be positioned centrally with respect to the housing 20 and would facilitate rotation.

Figure 7:
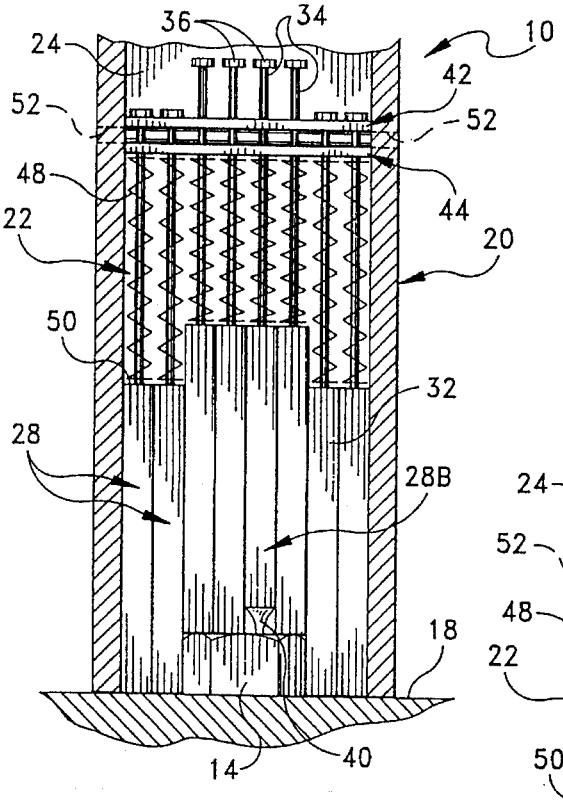
FIG. 7 is an enlarged cross-sectional view showing the manner in which the pins are displaced to accommodate a hex head bolt.
Figure 8:
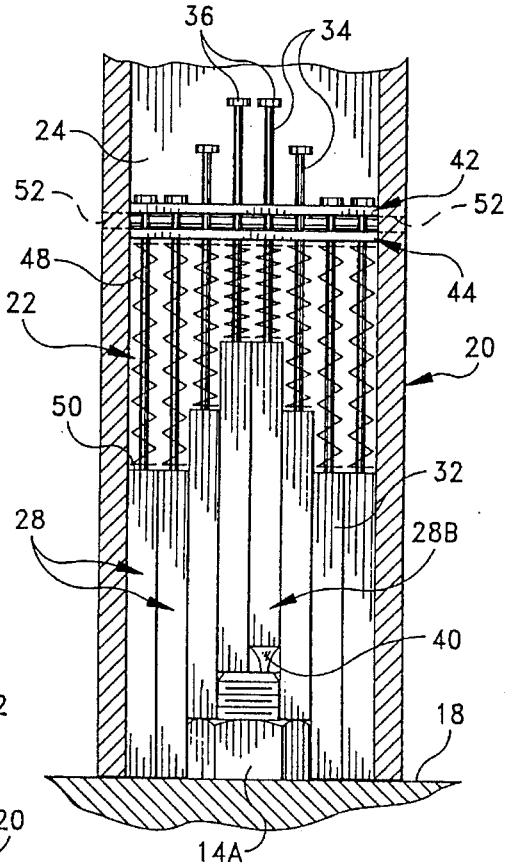
FIG. 8 is an another enlarged cross-sectional view showing the manner in which the pins are displaced to accommodate a hex nut and bolt.
Figure 9:
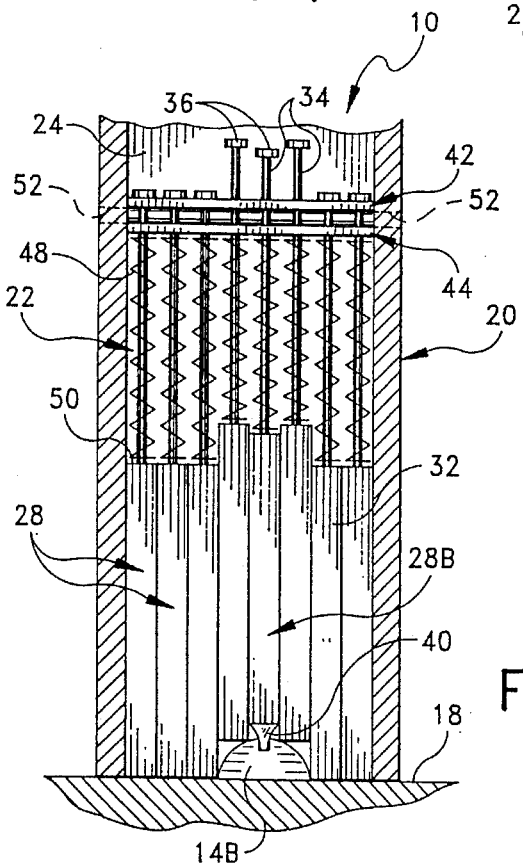
FIG. 9 is yet another enlarged cross-sectional view showing the manner in which the pins are displaced and received into the head of a slotted screw.
Figure 10:
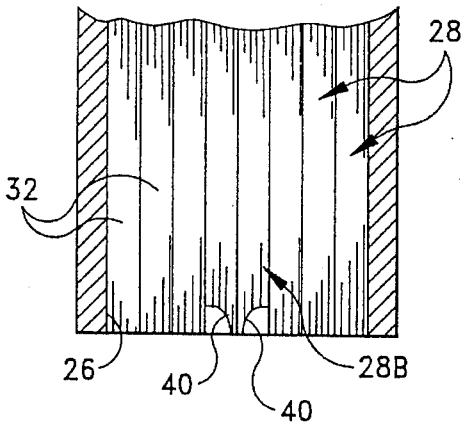
FIG. 10 is a cross-sectional view showing an alternative embodiment of the tapered end portions of the pins.

The pins 28 are suspended within the chamber 22 in individual sliding relation, wherein engagement of the square rods 32 of the pins 28 with a fastening element 14 forces the engaged pins 28 upwardly into the chamber 22 to a second position (See FIGS. 7–9). More specifically, the pins 28 are suspended within the chamber 22 by means of upper and lower suspension plates generally indicated at 42 and 44 respectively, mounted in closely spaced parallel spaced relation adjacent the upper end 24 of the chamber 22. The upper and lower suspension plates 42 and 44 are generally square in configuration although they have rounded corners to accommodate for the rounded internal corners of the housing 20. The two suspension plates 42 and 44 each include an eight-by-eight array of apertures 46 for slidably receiving the cylindrical stem portions 34 of the pins 28. The apertures 46 in the suspension plates 42 and 44 are aligned in overlying relation so as to form vertical guides for the pins 28 when they are assembled therein. Each of the pins 28 is assembled with the suspension plates 42 and 44 such that the flange 36 at the upper end of the pin 28 is positioned above the upper suspension plate 42 and the square rod portion 32 of the pin 28 is positioned below the lower suspension plate 44.

Each of the pins 28 further includes a compression spring 48 for returning the pins 28 from the second position to the first normal position after pressured engagement with the fastening element 14 is eliminated. The compression spring 48 is received around the stem portion 34 of each pin 28 and is captured between the lower suspension plate 44 and the shoulder 50 formed between the stem portion 34 and rod portion 32 of the pin 28. Assembly of the pins 28 is accomplished by extending the upper cylindrical stem portion 34 of the pin 28 through the aligned plate apertures 46, through the compression spring 48 and securing the stem portion 34 into the bore 38 in the rod portion 32 of the pin 28.

The suspension plates 42 and 44 and assembled pins 28 are mounted within the chamber 22 by two mounting rods 52 (FIG. 6) which extend laterally through the chamber 22 between the two spaced suspension plates 42 and 44. The ends of the rods 52 are secured by any suitable means within holes 54 in the outer wall of the housing 20.

Figure 4:
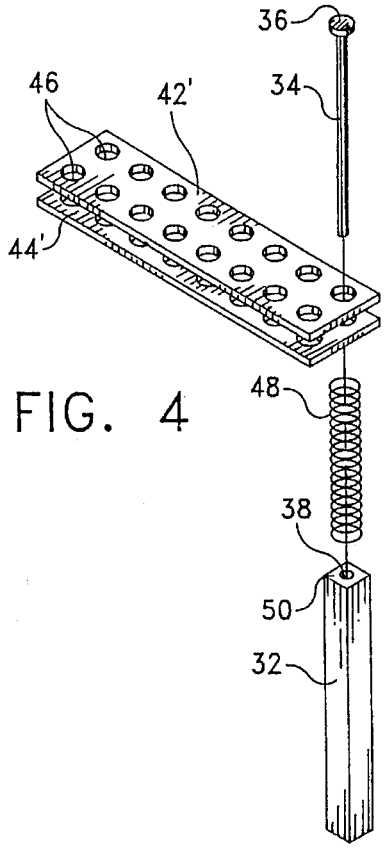
FIG. 4 is an exploded perspective view of a first embodiment of a pin sub-assembly therefor.
Figure 5:
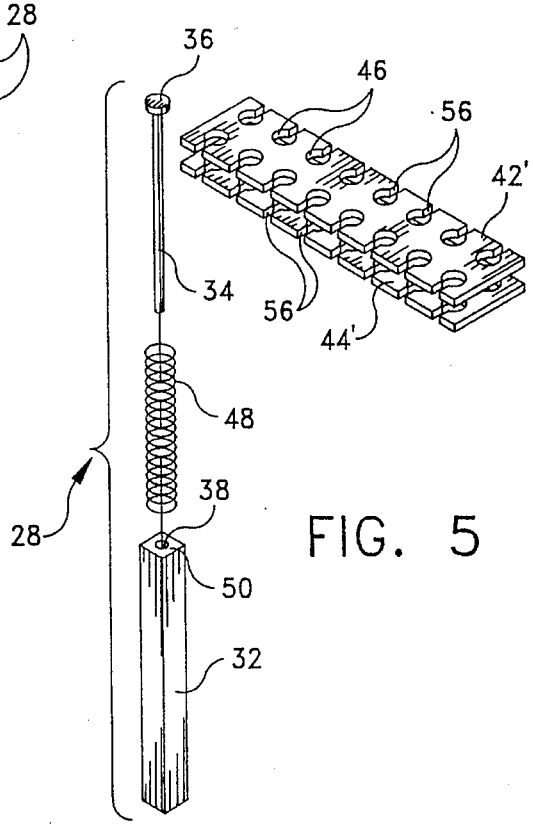
FIG. 5 is an exploded perspective view of second embodiment of a pin sub-assembly therefor.
Figure 6:
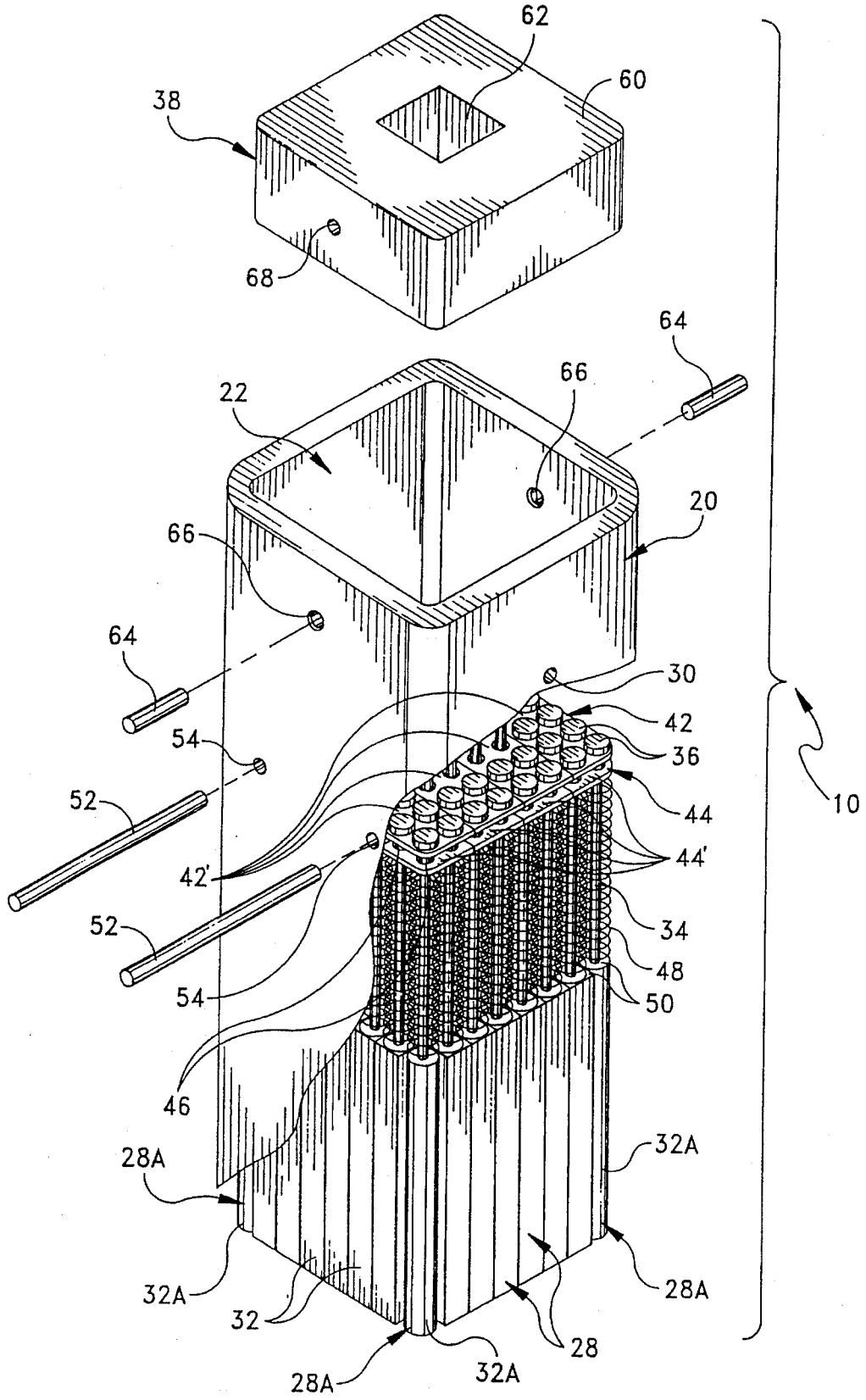
FIG. 6 is another perspective view, partially broken away and partially exploded, of the universal socket tool.

Referring to FIG. 4, the upper and lower. suspension plates 42 and 44 are preferably formed in four individual segments 42' and 44' each having a 2-by-8 array of apertures 46 therein. The segmented arrangement of the suspension plates 42 and 44 simplifies the assembly procedure by providing more working space in which the upper and lower pin portions 32 and 34 and the springs 48 can be manually manipulated. Referring to FIG. 5, an alternative arrangement of the plate segments 42' and 44' is illustrated. Each of the apertures 46 in the alternative plate segments 42' and 44' is provided with a slot 56 which extends outwardly to the peripheral edge of the plate. In this connection, the upper and lower ends 32 and 34 of the pin 28, and the spring 48 can be assembled independently of the suspension plates 42' and 44' and then the cylindrical stem 34 of the assembled pins 28 can be snap received into the apertures 46 from the side slots 56 of the plates 42' and 44'. The simplification of assembly accomplished by this alternative arrangement can readily be appreciated. It is pointed out that the mounting rods 52 must extend through the housing 20 perpendicular to the plate segments 42' and 44' in order to secure each of the plates within the housing 20 (See FIG. 6).

The universal socket tool 10 still further comprises a drive receptacle 58 for receiving the lug 16 of the socket driver 12. The drive receptacle 58 comprises a square body 60 having a square opening 62 centrally located therein. The drive receptacle 58 preferably comprises an integral body unit although it is contemplated that it could comprise a set of annular stacked plates. The body 60 of the drive receptacle 58 is slidably received into the upper end of the housing 20 wherein it is secured in position by two pins 64 which extend through apertures 66 in the outer wall of the housing 20 and into bores 68 in the receptacle body 60. The square opening 62 in the receptacle body is operative for snap receiving the lug 16 of the socket driver 12 so that the universal socket tool 10 can be used in a conventional manner.

In use, the pins 28 are pressed downwardly over the top of a fastening element 14, such as a hex head bolt (See FIGS. 1 and 7). In this connection, engagement of the rod portions 32 of the pins with the fastening element 14 forces the engaged pins 28 upwardly into the chamber 22 to a second position. The remaining unengaged pins 28 are operative for grasping the sides of the fastening element 14 and rotating the fastening element 14 when the socket tool 10 is rotated. Rotation of the socket tool 10 is accomplished by means of the socket driver 12 in a conventional manner. The pins 28 are returned to their normal resting position (FIG. 3) by the compression springs 48 when pressured engagement of the socket tool 10 over the fastening element 14 is eliminated.

Referring to FIGS. 8 and 9, displacement of the pins 28 in connection with a threaded nut 14A and a slotted screw head 14B is illustrated. In FIG. 9, it can be seen that the pins 28B having tapered end portions 40 are operative for engagement in the slotted head of the screw 14B for rotation thereof. It is again pointed out that the tapered ends 40 of the pins 28B are equally effective for engagement with the head of a phillips head screw (not shown).

While the size of the housing 20 has been specifically defined as comprising a one and one-quarter (1¼) inch square tubular housing, it is to be understood that smaller and larger size socket tools are also contemplated within the scope of the invention. However, it is pointed out that the size of the rod portions 32 (one-eighth inch square) of the pins 28 would remain the same for all embodiments up to two inches in size. For example, a one inch socket tool having an internal chamber dimension measuring three-quarter (¾) inch square would require a six-by-six array of one-eighth inch square pins. However, when the size of the socket tool exceeds two inches square, the size of the pins must increase to one-quarter (¼) inch. For example, a two and one-quarter (2¼) inch socket tool having an internal chamber dimension measuring two inches square would require an eight-by-eight array of one-quarter inch pins. It is pointed out that the one-eighth inch (⅛) and one-quarter inch (¼) sizes of the pins have particular significance in that it provides snug engagement for virtually all standard and metric size nuts. It has been found that the one-eighth and one-quarter inch size pins have a direct arithmetical proportion to virtually all sizes of nuts and bolts. A deviation of more than ten percent from the one-eighth and one-quarter inch sizes causes significant problems in allowing engagement with all sizes of nuts and bolts. It is further contemplated that the lower ends 32 could comprise allen-type pins wherein the universal socket tool would be operative for universally engaging all size allen head screws and bolts.

Figure 11:
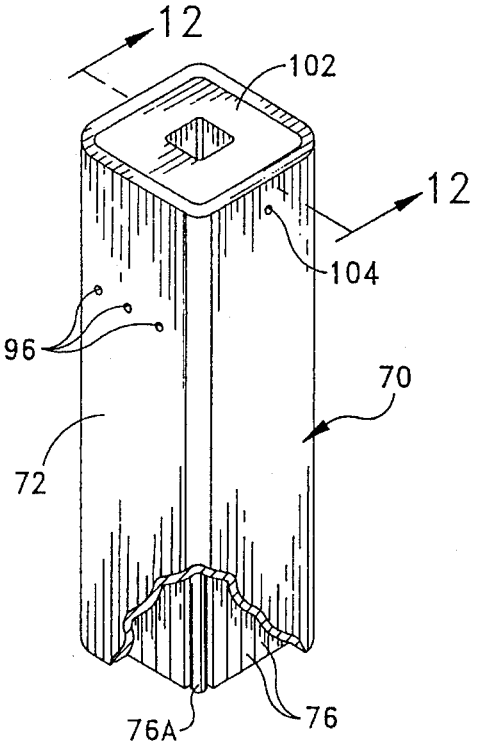
FIG. 11 is a perspective view of a second embodiment of the universal socket tool.
Figure 12:
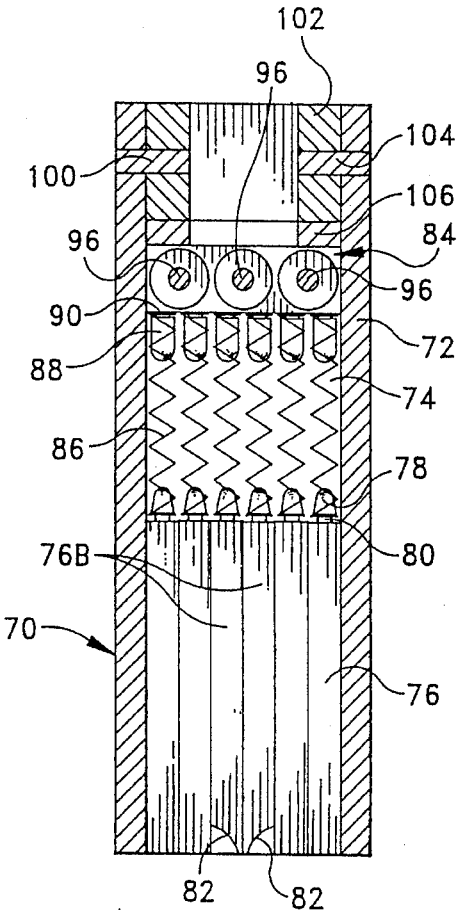
FIG. 12 is a cross-sectional view thereof taken along line 12—12 of FIG. 11.
Figure 13:
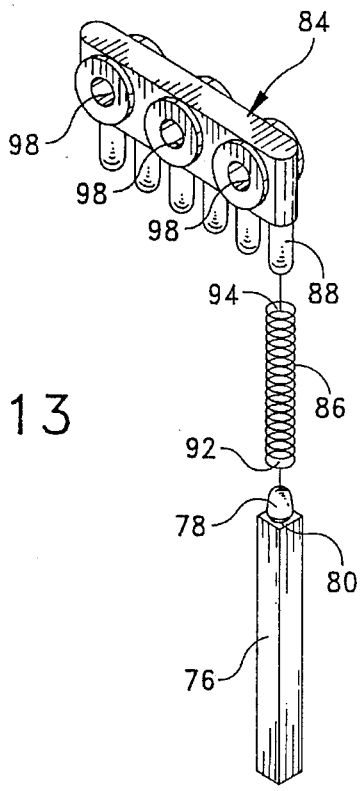
FIG. 13 is an exploded assembly view of the suspension assembly thereof.

Referring now to FIGS. 11–13, a second embodiment of the universal socket tool is illustrated and generally indicated at 70. Socket tool 70 comprises a one inch square housing 72 having an internal chamber 74, and further comprises a six-by-six array of one-eight inch square pins 76 suspended in the chamber 74. Each of the pins 76 preferably includes a rounded mounting head 78 which is supported by a neck 80. The corner pins 76A are preferably rounded to accommodate the rounded inner corners of the housing 72. Selected side-by-side pins 76B include tapered ends portions 82 for engagement with slotted screw heads. The pins 76 are suspended by means of a plurality of retainer elements generally indicated at 84 mounted in side-by-side relation adjacent the upper end of the chamber 74, and a plurality of springs 86. The retainer elements 84 are preferably fashioned from a synthetic resin material, and each preferably includes a plurality of downwardly extending mounting heads 88 supported by a neck 90. Each spring 86 has a first end 92 which is respectively received over mounting head 78 of a corresponding pin 76 and a second end 94 which is received over mounting head 88 on retainer element 84. Retainer elements 84 are mounted within chamber 74 by means of three mounting rods 96 which pass through aligned bores 98 (FIG. 13). Mounting rods 96 are secured within holes in the housing 72 as described previously. A spacer 100 and a drive receptacle 102 are mounted at the upper end of the housing 72. Drive receptacle 102 is mounted to housing 72 by means of pins 104 as previously described. In use, the tool 70 functions as previously described.

Figure 14:
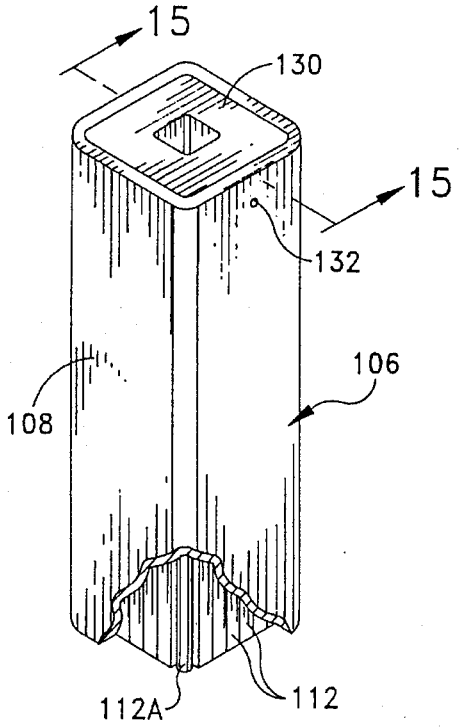
FIG. 14 is a perspective view of a third embodiment of the universal socket tool.
Figure 15:
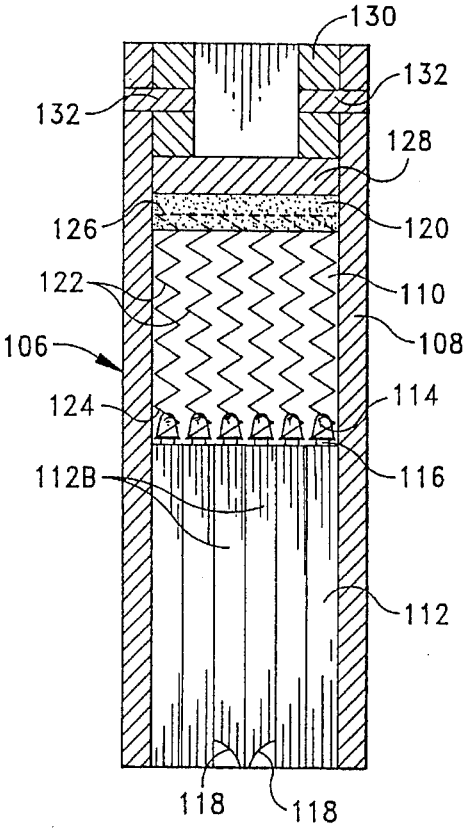
FIG. 15 is a cross-sectional view thereof taken along line 15—15 of FIG. 14.

Referring now to FIGS. 14 and 15, a third embodiment of the universal socket tool is illustrated and generally indicated at 106. Socket tool 106 comprises a one inch square housing 108 having an internal chamber 110, and further comprises a six-by-six array of one eight inch square pins 112 suspended in the chamber 110. The corner pins 112A are preferably rounded to accommodate the rounded inner corners of the housing 108. Each of the pins 112 preferably includes a rounded mounting head 114 which is supported by a neck 116. Selected side-by-side pins 112B include tapered ends portions 118 for engagement with slotted screw heads. The pins 112 are suspended in the chamber by means of an adhesive medium 120 (FIG. 15), and a plurality of springs 122. Each spring 122 has a first end 124 which is respectively received over mounting head 14 of a corresponding pin 112, and a second end 126 which is imbedded in the adhesive medium 120. In the alternative, spring 122 may be secured to pin 112 by welding, gluing, steaking, or any other suitable method. The adhesive medium 120 preferably comprises a synthetic resin, such as an epoxy glue. The resin is preferably poured into the chamber 110 in a liquid form wherein it is captured within the housing 108 by a solid plate 128 supported within the chamber 110 by drive receptacle 130. A preassembled array of pins 112 is then lowered into the chamber 110 wherein the ends 126 of the springs 122 are imbedded in the adhesive medium 120. When the adhesive 120 hardens, the spring ends 126 and the plate 128 are permanently secured within the housing 108. The drive receptacle 130 is mounted to the housing by means of pins 132 as previously described. In use, the tool 106 functions as previously described.

It can therefore be seen that the instant invention provides three separate unique and novel embodiments of a universal socket tool. The simplified designs of the socket tools lend themselves to simple and inexpensive manufacturing techniques. The enlarged one eighth inch size of the pins provides for snug engagement of virtually all standard and metric size nuts while significantly reducing the number of pins required in the array. The square shape of the housing provides a unique feature in that it prevents the socket tool from rolling when it is placed on a flat resting surface. While the enlarged size pins would not normally be effective for engagement with slotted or phillips head screws, a selected grouping of side-by-side pins in each of the embodiments is provided with tapered end portions for overcoming this problem. The suspension systems of the instant socket tools are greatly simplified thereby allowing simplified assembly while retaining the same effectiveness. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A universal socket tool comprising:

a rigid housing including a longitudinal chamber, said chamber having a closed upper end and an open lower end;

a plurality of pins each having upper and lower ends, said pins being longitudinally oriented in said chamber wherein said lower ends of said pins are positioned adjacent said lower end of said chamber for engagement with a fastener element;

a plurality of springs each having first and second ends;

means for securing said first ends of said springs to said upper ends of said pins; and a layer of adhesive material fixed to the upper end of the chamber, said second ends of said springs being imbedded in said layer of adhesive material whereby said pins are suspended for longitudinal movement within said chamber.

2. In the universal socket tool of claim 1, said means for securing said first ends of said springs to said upper ends of said pins comprising an upwardly extending head on each of said upper ends of said pins, said first ends of said springs being received over said heads on respective pins.

3. In the universal socket tool of claim 2, each of said heads including a reduced dimension neck portion adjacent said upper end of said pin.

4. In the universal socket tool of claim 1, said adhesive medium comprising a synthetic resin.

5. In the universal socket tool of claim 1, said pins including selected side-by-side pins having tapered lower end portions.

6. A universal socket tool comprising:

a rigid housing including a longitudinal chamber, said chamber having a closed upper end and an open lower end;

a plurality of pins each having upper and lower ends, said pins being longitudinally oriented in said chamber wherein said lower ends of said pins are positioned adjacent said lower end of said chamber for engagement with a fastener element, said upper ends of said pins each including an upwardly extending head portion supported by a reduced dimension neck portion;

a plurality of coil springs each having first and second ends, said first ends of said springs being secured to the head portions of respective pins;

a retainer element received in the upper end of said chamber, said retainer element including a plurality of downwardly extending head portions supported by a reduced dimension neck portion, said second ends of said springs being secured to the head portions of said retainer element whereby said pins are suspended for longitudinal movement within said chamber; and means for securing said retainer element in said upper end of said chamber.

7. In the universal socket tool of claim 6, said means for securing said retainer element comprising an opening extending laterally through said retainer element, and a mounting rod extending through said opening, said mounting rod being secured to said housing.

* * * * *